US010328354B2

(12) United States Patent
Bushell et al.

(10) Patent No.: US 10,328,354 B2
(45) Date of Patent: Jun. 25, 2019

(54) GIFT BOX WITH SELF-INFLATING BALLOON

(71) Applicant: Cardalloon Co. LLC, New York, NY (US)

(72) Inventors: Brian Craig Bushell, New York, NY (US); Ben Kaufman, New York, NY (US); Grant Chapman, Indianapolis, IN (US); Wade Cunningham, Indianapolis, IN (US); Scott Shephard, Weehawken, NJ (US); Andrew Westrick, Carmel, IN (US); Randy Parmerlee, Jr., Indianapolis, IN (US); Christopher Metzger, Zionsville, IN (US)

(73) Assignee: Cardalloon Co LLC, New York, NY (US)

( * ) Notice: Subject to any disclaimer, the term of this patent is extended or adjusted under 35 U.S.C. 154(b) by 0 days.

(21) Appl. No.: 15/907,179

(22) Filed: Feb. 27, 2018

(65) Prior Publication Data

US 2018/0243662 A1 Aug. 30, 2018

Related U.S. Application Data

(60) Provisional application No. 62/464,207, filed on Feb. 27, 2017.

(51) Int. Cl.
*A63H 27/00* (2006.01)
*A63H 27/10* (2006.01)
(Continued)

(52) U.S. Cl.
CPC ..... *A63H 27/10* (2013.01); *A63H 37/00* (2013.01); *B65D 5/0254* (2013.01);
(Continued)

(58) Field of Classification Search
CPC ..... A63H 27/10; A63H 37/00; A63H 2027/1033; A63H 2027/1083; B65D 5/0254; B65D 5/5014
(Continued)

(56) References Cited

U.S. PATENT DOCUMENTS 4,167,204 A * 9/1979 Zeyra ..... A63B 41/12 137/231
4,813,902 A 3/1989 Messer
(Continued)

FOREIGN PATENT DOCUMENTS

DE 3916701 A1 11/1990

*Primary Examiner* — Vishu K Mendiratta
(74) *Attorney, Agent, or Firm* — Fenwick & West LLP

(57) ABSTRACT

A gift box with a self-inflating balloon is designed to be shipped to a recipient through the mail. A lid of the box is configured to be opened and may display a personalized message relating to a special occasion of the recipient. The box includes the balloon, which may be hidden from view in a compartment of the box. The box includes a switch that is configured to be actuated by the recipient. Upon actuating the switch, an inflation device is activated and begins to inflate the balloon, which emerges from the compartment of the box. A vibrating motor inside the box may synchronously cause the box to vibrate. After a pre-determined amount of time, the inflation device and motor deactivate, and a valve seals the air inside the balloon. Once the balloon is inflated, the gift box and balloon may be displayed for the recipient.

22 Claims, 7 Drawing Sheets

(51) Int. Cl.
*B65D 5/02* (2006.01)
*B65D 5/50* (2006.01)
*A63H 37/00* (2006.01)

(52) U.S. Cl.
CPC .... *B65D 5/5014* (2013.01); *A63H 2027/1033* (2013.01); *A63H 2027/1083* (2013.01)

(58) Field of Classification Search
USPC ..... 446/220, 221
See application file for complete search history.

(56) References Cited

U.S. PATENT DOCUMENTS 4,903,958 A 2/1990 DiCarlo et al.
4,911,379 A 3/1990 Kopelman
4,920,674 A * 5/1990 Shaeffer ..... A63H 27/10 116/210
5,083,771 A * 1/1992 Tyner ..... A63H 27/10 116/DIG. 9
5,108,337 A * 4/1992 Sloan ..... A63H 27/10 222/402.14
5,234,726 A 8/1993 Dahan
5,293,707 A * 3/1994 Shaeffer ..... A63H 27/10 40/214
5,573,437 A 11/1996 Van Dyke et al.
5,579,813 A * 12/1996 Watts ..... A63H 13/16 116/DIG. 9
5,582,127 A 12/1996 Willis et al.
5,651,402 A 7/1997 McCaul
5,852,889 A 12/1998 Rinaldi
5,935,013 A * 8/1999 McLennan ..... A63H 13/16 239/309
6,158,588 A 12/2000 Conti
6,200,193 B1 * 3/2001 Nadel ..... A63H 5/00 446/397
6,302,171 B1 * 10/2001 Watts ..... A63H 27/10 116/DIG. 9
6,373,384 B1 4/2002 Ferguson et al.
7,765,727 B2 8/2010 Chen
7,810,719 B2 10/2010 Clegg et al.
7,886,682 B1 2/2011 Germain et al.
9,449,475 B2 9/2016 Aguilar
9,533,804 B2 1/2017 Shlonsky et al.
2014/0224699 A1 8/2014 Smith
2015/0279241 A1 10/2015 Kershner et al.
2016/0272386 A1 9/2016 Marsh
2016/0290627 A1 10/2016 Payne et al.
2017/0043271 A1 * 2/2017 Halliburton ..... A63H 27/10

* cited by examiner

GIFT BOX WITH SELF-INFLATING BALLOON

CROSS-REFERENCE TO RELATED APPLICATIONS

This application claims the benefit of U.S. Provisional Patent Application No. 62/464,207, filed Feb. 27, 2017, the disclosure of which is hereby incorporated by reference in its entirety.

BACKGROUND

This disclosure relates generally to gift boxes, and more specifically to a gift box device with a self-inflating balloon.

Traditionally, greeting cards are sent through the mail to close friends or relatives for special occasions, such as birthdays, anniversaries, graduations, or other events that are cause for celebration. While the intentions of the person sending the greeting card are well-meaning and thoughtful, the experience of opening a greeting card can be lackluster for the person receiving it. Furthermore, once a card has been opened and read, the recipient is often unsure of whether to save the card or throw it away. Some existing greeting cards try to enhance the experience with three-dimensional pop-out features or by playing music when the card is opened. However, even with these added features, the card is still just a card that may sit on a shelf forgotten, or may be thrown away.

SUMMARY

Embodiments relate to a gift box with a self-inflating balloon. In one embodiment, the device includes a balloon, an inflation device, and a controller located within a housing. The balloon includes an opening, and the inflation device is in fluid communication with the opening of the balloon. The controller is coupled to the inflation device and is configured to activate the inflation device such that air flows into the balloon, inflating the balloon.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

One embodiment includes a gift box device that is designed to be shipped to a recipient through the mail. The recipient may have a special occasion coming up, such as a birthday, wedding, anniversary, graduation, or any other cause for celebration, or the box may be sent to the recipient as a humorous "gag" gift or as a simple "thinking of you." A lid of the box is configured to be opened and may display a personalized message relating to a special occasion of the recipient. The box includes a balloon, which may be hidden from view in a compartment of the box. The box includes a switch that is configured to be actuated by the recipient. When the switch is actuated, an inflation device is activated and begins to inflate the balloon, which emerges from the compartment of the box. A vibrating motor inside the box may synchronously cause the box to vibrate. After a predetermined amount of time, the inflation device and motor deactivate, and a valve seals the air inside the balloon. Once the balloon is inflated, the gift box and balloon may be displayed for the recipient.

Figure 1:
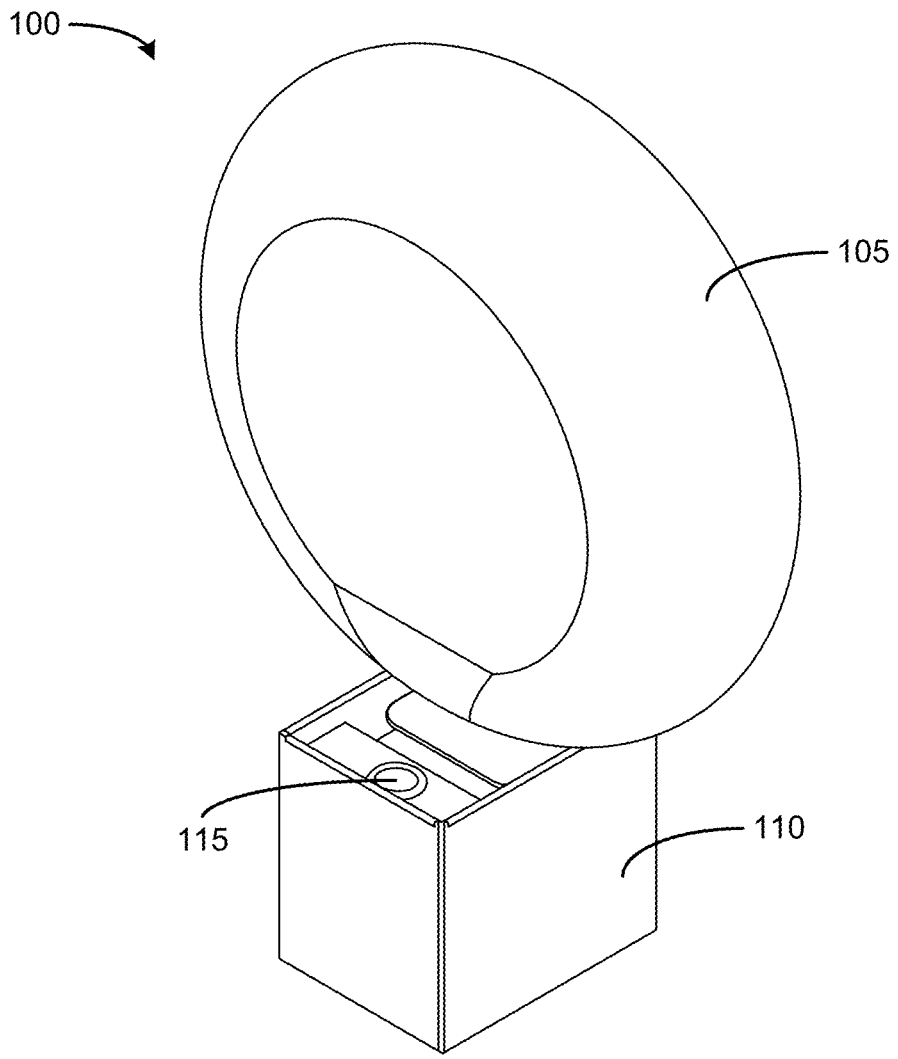
FIG. 1 illustrates a gift box with a self-inflating balloon, according to an embodiment.

FIG. 1 illustrates a gift box 100 with a self-inflating balloon 105, according to an embodiment. In the embodiment of FIG. 1, the gift box 100 includes the balloon 105, a housing 110, a switch 115, and a lid (shown in FIGS. 4A-4B). The gift box 100 is illustrated in a final configuration, where the lid is in an open position and the balloon 105 is in an inflated state. While the balloon 105 is shown in a fully inflated state, the degree to which the balloon 105 is inflated may vary based on a type of the balloon or a target capacity.

The balloon 105 is a flexible bag designed to be inflated with a fluid, which may be a liquid or a gas. The balloon 105 may be in a deflated state when the gift box 100 is shipped to the recipient, and the balloon 105 may be inflated when the recipient receives the gift box 100. The balloon 105 includes an opening (not shown) that is coupled to an inflation device that inflates the balloon, which is discussed in further detail with regard to FIGS. 2-3. In the embodiment shown in FIG. 1, the balloon 105 may be composed of latex, Mylar nylon, foil, or similar types of material. While the balloon 105 is illustrated as a circular balloon, the balloon 105 may come in a variety of different shapes and sizes. For example, the design of the balloon 105 may correspond to the special occasion (e.g., heart-shaped, birthday cake-shaped, one or more numbers, a graduation cap, etc.). The balloon 105 may also include a message appropriate for the special occasion, such as "Happy Birthday!" or "Congratulations!"

The housing 110 is a box that houses the balloon 105 and other internal components of the gift box 100. The housing 110 includes a lid (shown in FIGS. 2A-2B) that may seal the housing 110 such that the housing 110 can be shipped through the mail. Shipping may occur via a shipping or mailing service (e.g., FedEx, UPS, postal service), a courier service, or other similar delivery services. In this configuration, the gift box 100 is designed ready-to-ship and may not need additional shipping or packaging materials. The housing 110 may be composed of cardboard, corrugated cardboard, foam board, or other suitable materials.

The switch 115 activates an inflation device inside the housing 110, which inflates the balloon 105. The switch 115 may be a button, a switch, a pull tab, a pull string, or a similar trigger mechanism designed to be actuated by the recipient. In the embodiment of FIG. 1, the switch 115 is positioned inside the housing 110 and is accessible to the recipient when the lid of the housing 110 is in an open position. When actuated, the switch 115 activates the inflation device and, in some embodiments, may synchronously activate one or more special effects of the gift box 100 (e.g., lights, music, shaking, etc.). In some embodiments, opening the lid of the housing 110 or breaking the seal between the lid and the housing 110 may act as the trigger mechanism such that the recipient does not actuate a switch to activate the inflation device and/or special effects.

Figure 2B:
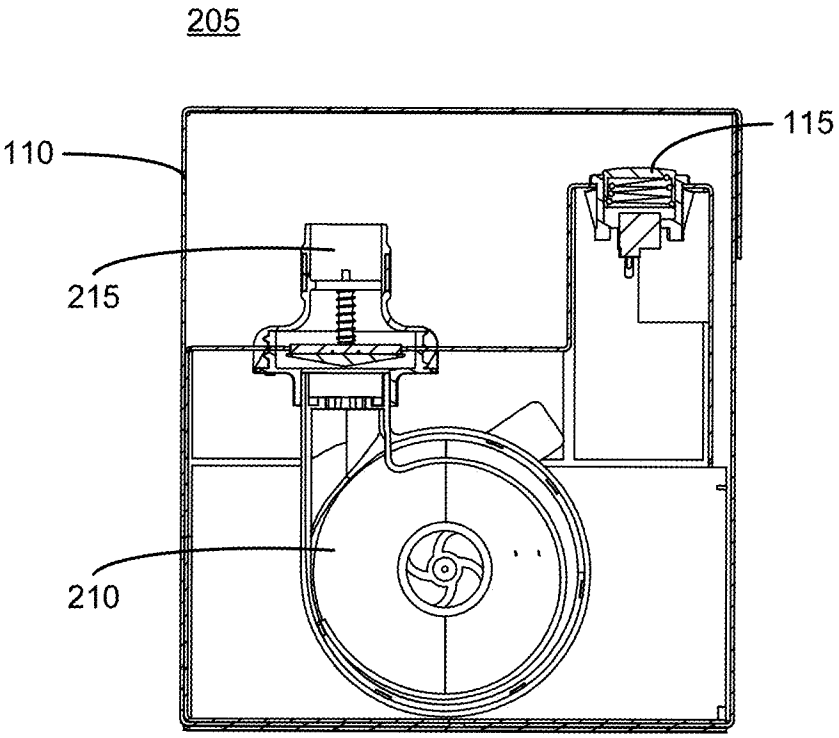
FIGS. 2A-2D illustrate cross-sectional views of the gift box, according to an embodiment.
Figure 2A:
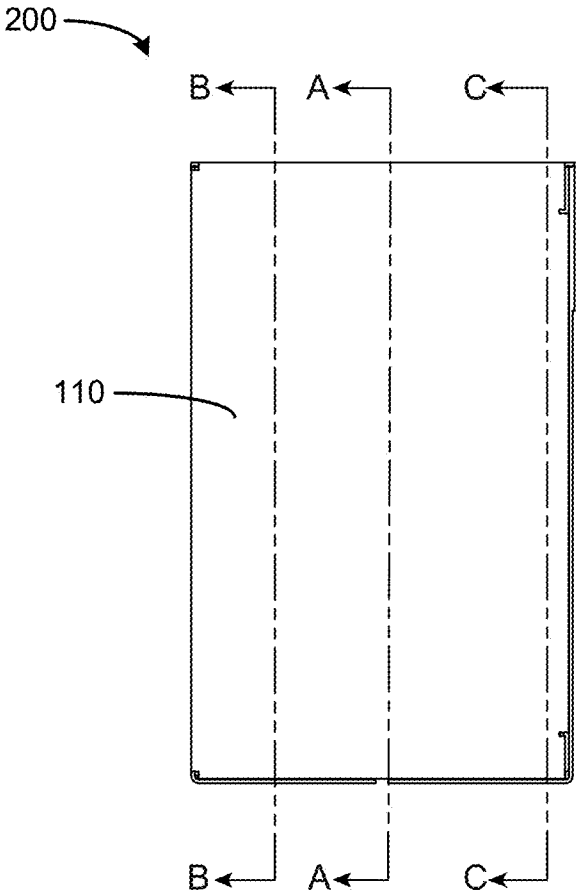

FIGS. 2A-2D illustrate cross-sectional views of the gift box 100, according to an embodiment. FIG. 2A is a left side view 200 of the gift box 100 (front side is facing right) and illustrates three cross-sections, A-A, B-B, and C-C, that are discussed with regards to FIGS. 2B-2D.

FIG. 2B illustrates a cross-sectional view 205 of the gift box 100. The cross-sectional view 205 shown is the cross-section A-A indicated in FIG. 2A that is taken through approximately the middle of the gift box 100. FIG. 2B illustrates the switch 115 and an inflation device 210 that couples to the balloon 105 (not shown) via a valve 215. As described with regards to FIG. 1, the switch 115 activates the inflation device 210. Each of these components may be mounted inside the housing 110.

The inflation device 210 inflates the balloon. The inflation device 210 couples to an opening of the balloon such that airflow from the inflation device 210 flows into the opening of the balloon and inflates the balloon. In the embodiment of FIG. 2B, the inflation device 210 is an electric air pump. The electric air pump fills the balloon with enough air to inflate the balloon at a target flow rate and pressure. For example, the electric air pump may inflate the balloon within a range of approximately 5 seconds to 20 seconds, such that a recipient of the gift box 100 may enjoy watching the balloon emerge out of the gift box 100 as it inflates. The type of electric air pump may be selected based on its specifications, such as product weight, dimensions, voltage ratings, current ratings, and resistance ratings. In the embodiment of FIG. 2B, the inflation device 210 operates using a 12-volt direct current power source.

In alternate embodiments, the inflation device 210 may be a source of compressed gas. For example, the inflation device 210 may be one or more compressed $CO_2$ canisters that fill the balloon 105 with $CO_2$. Commercially available $CO_2$ canisters are typically stored at around 800 pounds per square inch (psi), whereas a balloon may rupture approximately between 0.25 psi to 0.5 psi. Thus, a regulating valve may be used in conjunction with the $CO_2$ canisters to regulate the pressure of the balloon; the regulating valve may control the amount of $CO_2$ delivered to the balloon as well as vent off any excess $CO_2$ once the balloon is filled to a target capacity. The regulating valve may be designed to regulate the speed at which the $CO_2$ enters the balloon. If the $CO_2$ canisters are rapidly emptied into the balloon, the $CO_2$ gas is rapidly depressurizing and thus becomes cold at standard room pressure. As a result, the $CO_2$ gas inside the balloon may near freezing temperatures and cause the material of the balloon to become brittle, potentially causing the balloon to pop upon inflating.

In one embodiment, the regulating valve includes a first end that couples to the one or more $CO_2$ canisters and a second end that couples to the balloon. The regulating valve may be designed such that the inlet pressure at the first end (800 psi) drops to a target pressure (approximately 0.25 psi) due to the size of the openings at each end and the length of the regulating valve. The opening at the first end may be small to restrict the flow rate of the $CO_2$ at the first end, and the pressure further drops along the length of the regulating valve, thus achieving the target pressure at the opening of the balloon.

In addition, the regulating valve may be designed to vent excess $CO_2$ to the atmosphere once the balloon is sufficiently inflated. Once the balloon is inflated, the flow rate through the regulating valve may decrease or approach zero, and the pressure inside the regulating valve may subsequently increase. The regulating valve may include a vent that opens once the pressure reaches or exceeds a threshold release pressure. In one embodiment, the vent includes a plunger and a spring that holds the plunger in a sealed position such that the vent of the regulating valve is closed. Once the threshold release pressure is reached or exceeded, the pressure may displace the plunger from its sealed position and compress the spring, thereby opening the vent to allow $CO_2$ to release. In this configuration, the higher the pressure above the threshold release pressure, the more the plunger will be displaced. The vent may be located along the length of the regulating valve and may be positioned near the first end closer to the $CO_2$ canister(s). This allows there to be a gradient of pressure between the vent and the balloon such that rapid pressure increases due to a decreased flow rate will open the vent before hitting the balloon (and potentially popping it).

In some instances, more than one compressed gas canister may be needed to fill the balloon to the target capacity. In these instances, an accumulator device, which is a pressure storage device that accepts, stores, and releases pressure as needed, may be used to couple the compressed gas canisters to the balloon. An accumulator device may couple one or more compressed gas canisters together such that the compressed gas canisters act as a single unit that delivers compressed gas to the balloon. The accumulator device may include a valve or nipple feature that couples to the opening of the balloon. The compressed gas canisters are installed into the accumulator device such that each cylinder is sealed to the accumulator device before the compressed gas canisters are punctured and pressure is allowed to enter the accumulator device. If any compressed gas canister is not sealed to the accumulator device before the compressed gas canisters are punctured, then compressed gas may leak out of the accumulator device and each compressed gas canister would be replaced.

If the gift box 100 is designed to be shipped through the mail, the configuration of the compressed gas canisters, the regulating valve, and/or the accumulator device may be designed to comply with federal shipping regulations. For example, puncturing the compressed gas containers before shipping may void the shipping regulations and require the gift box 100 to be recertified before the gift box 100 can be shipped, which may be a costly and time-consuming practice. An additional challenge with shipping compressed gas is that extra care must be taken to ensure that compressed gas will not leak out of its canister. Each canister, valve, and/or accumulator device must be of sufficient strength and robustness such that no leakage can occur while in transit. As such, an electric air pump as the inflation device 210 may allow the gift box 100 to be manufactured and shipped in a more cost-effective and convenient manner.

The valve 215 couples the inflation device 210 and the balloon. The valve 215 has a first end that may be inserted into the opening of the balloon and a second end that may be inserted into a port on the inflation device 210 (or vice versa, where the port may be inserted into the second end). In the embodiment of FIG. 2B, the valve 215 may be a one-way valve that allows airflow from the inflation device 210 into the balloon and prevents airflow out of the balloon 105, thus sealing the balloon. The valve 215 will be discussed in further detail with regards to FIGS. 3A-3B.

Figure 2D:
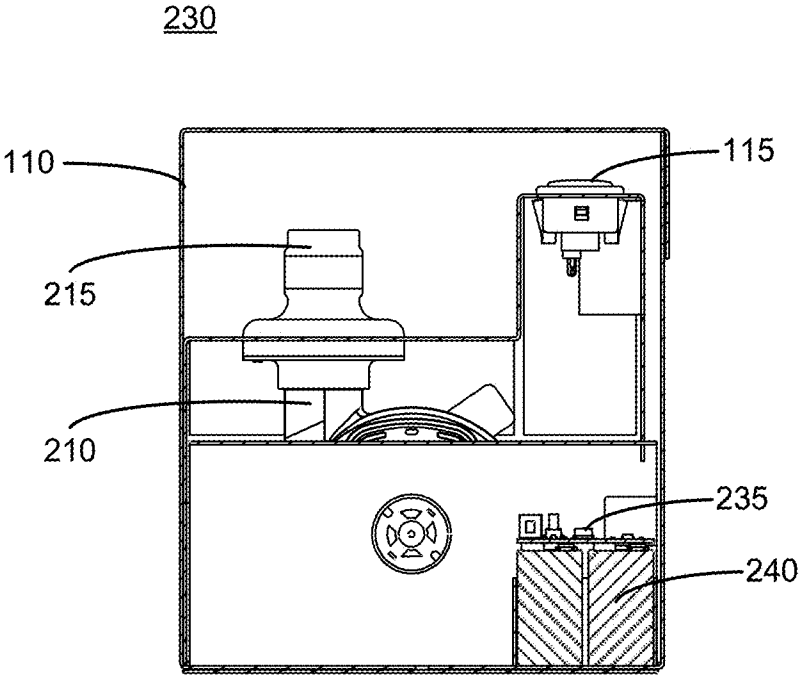
Figure 2C:
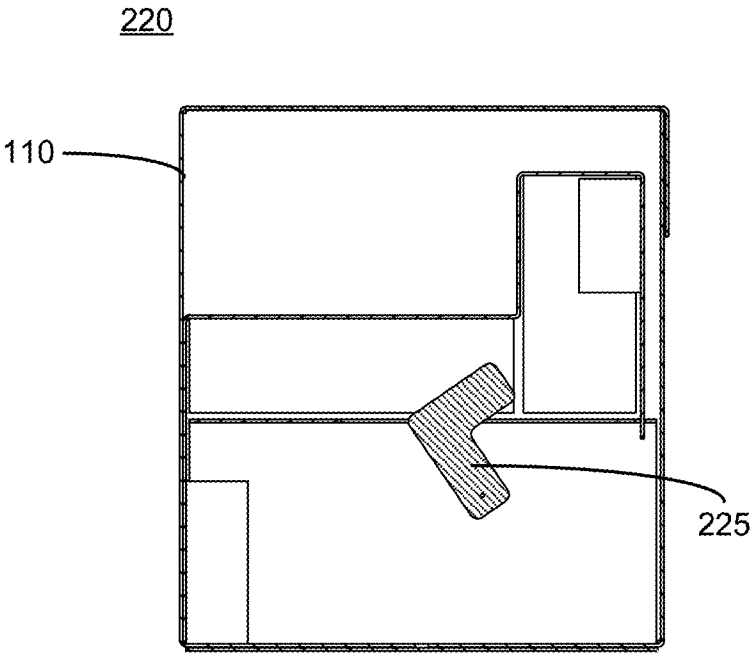

FIG. 2C illustrates a cross-sectional view 220 of the gift box 100. The cross-sectional view 220 shown is the cross-section B-B indicated in FIG. 2A that is taken through approximately near a left side of the gift box 100. FIG. 2C illustrates a motor 225 that may be mounted inside the housing 110. In the embodiment of FIG. 2C, the motor 225 is coupled to a counterweight via a rotor of the motor 225 such that the motor 225 causes the counterweight to rotate relative to the motor 225. In this configuration, the motor 225 remains stationary relative to the gift box 100 while the counterweight rotates, thereby causing the gift box 100 to shake. The counterweight enables the effect of the vibration from the motor 225 to be modified, and properties of the counterweight, such as geometry, weight, and orientation relative to the motor 225, may be modified to further customize the vibration of the gift box 100. In some embodiments, the switch 115 synchronously activates the motor 225 and the inflation device 210 such that the gift box 100 shakes as the balloon inflates. Similarly, the motor 225 and the inflation device 210 may be deactivated synchronously. In the embodiment of FIG. 2C, the motor 225 is a direct current (DC) motor, but any suitable motor may be used to generate vibrations of the gift box 100.

FIG. 2D illustrates a cross-sectional view 230 of the gift box 100. The cross-sectional view 230 shown is the cross-section C-C indicated in FIG. 2A that is taken through approximately near the right side of the gift box 100. FIG. 2D illustrates the switch 115, a portion of the inflation device 210, the valve 215, a circuit board 235, and a power source 240. Each of these components may be mounted inside the housing 110.

The circuit board 235 controls the operation of the gift box 100. The circuit board 235 electrically connects the electronic components of the gift box 100, such as the switch 115, the inflation device 210, the motor 225 (shown in FIG. 2C), and the power source 240. In the embodiment of FIG. 2D, the circuit board 235 is a printed circuit board that has a microcontroller with firmware to dictate its operation. The inputs to the circuit board 235 include the switch 115 and the power source 240, while the outputs of the circuit board 235 are the inflation device 210 and motor 225. The outputs may include different types of power controllers, such as metal-oxide-semiconductor field-effect transistors (MOSFET) or insulated-gate bipolar transistors (IGBT). Generally, the electronic components are soldered to the circuit board 235 to both electrically and mechanically couple them to it.

The circuit board 235 controls the operation of the inflation device 210. For example, the circuit board 235 controls the activation and deactivation of the inflation device 210. In the embodiment of FIG. 2D, the circuit board 235 detects that the switch 115 is actuated by the recipient, and, in response to detecting an actuation event of the switch 115, the circuit board 235 activates the inflation device 210. In some embodiments, the circuit board 235 may detect that a lid of the gift box 100 is in an open position (e.g., via a sensor), and, in response, the circuit board 235 activates the inflation device 210. The circuit board 235 may be programmed to activate the inflation device 210 for a predetermined amount of time (e.g., between a range of approximately 5 seconds to 20 seconds or other suitable amount of time), such that the programmed amount of time enables the inflation device 210 to sufficiently inflate the balloon. In some embodiments, the circuit board 235 may be programmed such that if the circuit board 235 detects a second or subsequent actuation event of the switch 115, the circuit board may activate the inflation device 210 for a predetermined amount of time that is shorter, such that the shorter programmed amount of time (e.g., between a range of approximately 1 seconds to 4 seconds or other suitable amount of time) enables the inflation device 210 to inflate the balloon to "top off" the balloon 105.

In addition, the circuit board 235 controls the operation of the motor 225. For example, the circuit board 235 controls the activation and deactivation of the motor 225. As previously described, the circuit board 235 may detect an actuation event of the switch 115. In response to detecting the actuation event of the switch 115, the circuit board activates the motor 225 to cause the gift box 100 to shake. In the embodiment of FIG. 2D, the circuit board 235 activates the motor 225 synchronously with the inflation device 210. For example, the circuit board 235 may activate the motor 225 and the inflation device 210 at the same time, or the circuit board 235 may activate the motor 225 slightly before or after the inflation device 210. In the embodiment of FIG. 2D, the circuit board 235 delivers a varied voltage through pulse-density modulation to the motor 225 such that the motor 225 causes rotation of the counterweight in an inconsistent manner, thereby causing the gift box 100 to shake erratically. The circuit board 235 may be programmed to deliver other types of voltage patterns to modify the vibration of the gift box 100.

The circuit board 235 may be programmed with a feature to ensure the inflation device 210 and/or the motor 225 are not unintentionally activated (for example, during shipping of the gift box 100). The circuit board 235 may have a programmable time-out for the switch 115 that is set for a predetermined amount of time (e.g., between a range of approximately 0 seconds to 0.75 seconds). In this configuration, if the circuit board 235 detects an actuation event of the switch 115 that falls within the time-out range, the circuit board 235 will not activate the inflation device 210 or the motor 225. The circuit board 235 may activate the inflation device 210 and/or the motor 225 if the duration of the actuation event is longer than the threshold of the time-out range. In alternate embodiments, the circuit board 235 may be programmed such that the inflation device 210 and/or the motor 225 will not activate if the circuit board 235 detects that the lid is closed (e.g., via a sensor or cutoff switch).

The power source 240 powers the operation of the gift box 100. In the embodiment of FIG. 2D, the power source 240 is a pair of removable standard high-rate 9-volt batteries that are electrically coupled to the circuit board 235 via standard 9-volt terminal connectors. The 9-volt batteries are connected in series, creating an 18-volt direct current power source for the inflation device 210. The gift box 100 may use 2-4 batteries to power the inflation device 210. The number and types of batteries may vary (different voltages, different configurations such as in series or in parallel, high energy, long lasting, etc.) depending on the size of the balloon to be inflated, the power requirements of the inflation device 210, the motor 225, and the predetermined fill rate and fill time for the balloon 105. Power controllers may also be used to appropriately couple the electronic components based on the specifications of each component. In the embodiment of FIG. 2, the inflation device 210 operates using a 12-volt direct current power source. Since the power source 240 is powering the inflation device 210 under a high load, the voltage of the power source 240 may beneficially decrease from 18-volts (to approximately 8.5-volts to 12-volts) when under load due to the resistance of the batteries. Other types of batteries may have less of a voltage drop, causing the batteries to overpower the inflation device 210. The 9-volt batteries are low-cost and readily available and have an appropriate voltage drop and high level of safety.

Figure 3A:
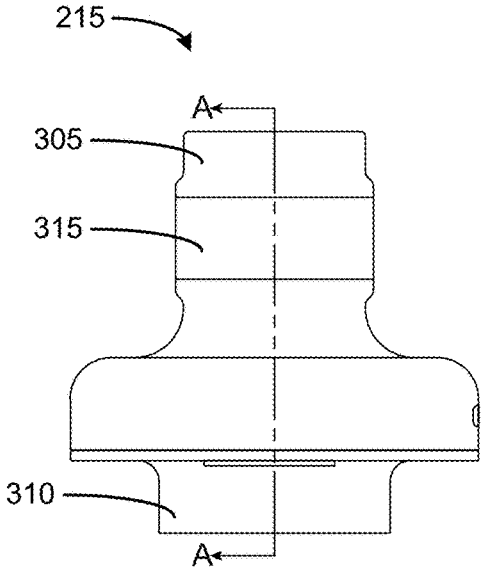
FIGS. 3A-3B illustrate a valve and a cross-sectional view of the valve, according to an embodiment.
Figure 3B:
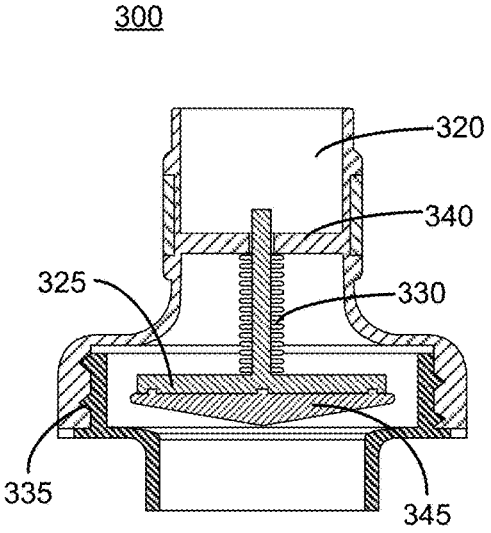

FIGS. 3A-3B illustrate a valve 215 and a cross-sectional view 300 of the valve 215, according to an embodiment. As previously described, the valve 215 couples an inflation device and a balloon. The inflation device may be an embodiment of inflation device 210, and the balloon may be an embodiment of balloon 105. The valve 215 has a first end 305 that may be inserted into the opening of the balloon and a second end 310 that may be inserted into a port on the inflation device (or vice versa, where the port may be inserted into the second end). The first end 305 includes a sealing surface 315 that mates with an inside surface of the balloon through the opening of the balloon. The sealing surface 315 may include an adhesive to adhere to the balloon or may be a friction fit or tapered friction fit to secure the balloon. A securing mechanism, such as a clamp, band, or other suitable component, may wrap around an outside surface of the balloon to secure the balloon at the sealing surface 315.

In the embodiment of FIGS. 3A-3B, the valve 215 is a one-way valve that allows airflow from the inflation device into the balloon and prevents airflow out of the balloon, thus sealing the balloon. The cross-sectional view 300 in FIG. 3B illustrates the internal components of the valve 215, which includes a channel 320, a plunger 325, and a spring 330. The cross-sectional view 300 also shows the first end 305 secured to the second end 310 via a mating surface 335. In the embodiment of FIG. 3B, the mating surface 335 is a threaded interface, but the mating surface 335 may be adhered or designed as a compression fit, friction fit, or other suitable securing mechanism in other embodiments. In this configuration, the first end 305, the second 310, the plunger 325, and the spring 330 may be assembled.

The channel 320 is a pathway between the inflation device and the balloon for air to flow through. In the embodiment of FIG. 3B, the channel 320 extends from an opening of the first end 305 to an opening of the second end 310. In this configuration, the balloon coupled at the first end 305 is in fluid communication with the inflation device coupled at the second end 310 such that airflow from the inflation device flows into the balloon. The channel 320 may include a structure at the first end 305 that serves as an alignment guide 340 for the plunger 325. The alignment guide 340 may extend across the diameter of the channel 320 and include a hole through its center while maintaining the open passageway of the channel 320 on the surrounding sides of the alignment guide 340.

The plunger 325 controls the airflow through the channel 320. In the embodiment of FIG. 3B, the valve 215 is a one-directional valve where the plunger 325 allows airflow into the balloon and prevents airflow out of the balloon. The plunger 325 includes a piston 345 and a sealing surface 350. The piston 345 is a protrusion that slides through the alignment guide 340. In the embodiment of FIG. 3B, the piston 345 is a slip fit through the alignment guide 340 and is cylindrically-shaped, which enables the piston 345 to rotate freely within the alignment guide 340. In alternate embodiments, the piston 345 may have a different polygonal shape that prevents rotation of the plunger 325 relative to the valve 300. The piston 345 aligns the plunger within the channel 320 and ensures that the plunger 325 is appropriately positioned such that the plunger 325 is able to seal the channel 320. The length of the piston 345 is such that at least a portion of an end of the piston 345 remains within the alignment guide 340 even when the plunger 325 is in a sealed position (to prevent the piston 345 from falling out and becoming misaligned). The sealing surface 350 is designed to abut the channel 320 at the second end 310 to seal the channel 320. The sealing surface 350 may be composed of a soft material (e.g., rubber, silicone, or other suitable plastic) that may be compressed when abutting the channel 320 to create a seal.

The spring 330 is a steel compression spring that is positioned on the piston 345. The spring 330 forces the plunger 325 into a sealed position against the channel 320, preventing airflow through the channel 320. When the inflation device is activated, the pressure from the airflow generated pushes the plunger 325 up and compresses the spring 330, allowing air to flow into the balloon. When the inflation device is deactivated, the spring 330 causes the plunger 325 to revert back to its sealed position, thereby sealing air inside the balloon. The spring rate of the spring 330 in relation to the surface area of the plunger 325 in relation to the pressure generated by the inflation device are balanced to accomplish the goals of allowing rapid inflation of the balloon while sealing the air in the balloon for extended periods of time.

The valve 215 and the plunger 325 may be composed of rigid materials (e.g., hard plastics or metals). In some embodiments, the valve 215 and the plunger 325 may be injection-molded. The sealing surface 350 may be overmolded onto the plunger 325 during the injection-molding process. Alternate embodiments of the valve 215 may include the plunger 325 and spring 330 in different configurations or orientations that achieve the same principle of sealing a portion of the channel 320 and allowing airflow in a single direction.

Figure 4:
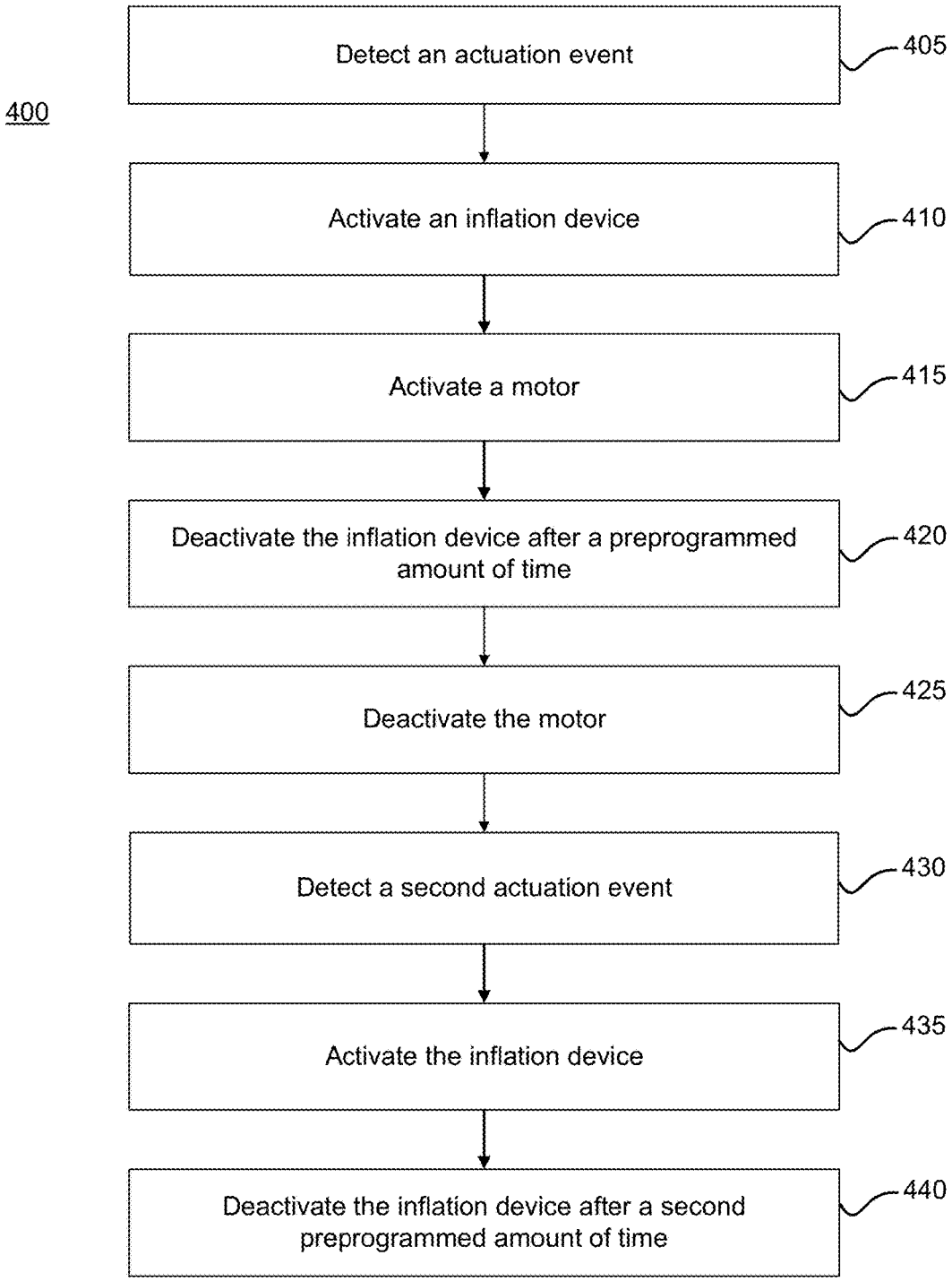
FIG. 4 illustrates a flowchart of a method for operating the gift box, according to an embodiment.

FIG. 4 illustrates a flowchart of a method 400 for operating the gift box 100, according to an embodiment.

A circuit board (e.g., circuit board 235) detects 405 an actuation event. The actuation event may be a button press, a switch flip, a pull of a pull string or a pull tab, or a similar trigger by a recipient of the gift box. In some embodiments, the actuation event may be an opening of a lid of the gift box or a breaking of a seal between the lid and a housing of the gift box.

The circuit board activates 410 an inflation device (e.g., inflation device 210). In some embodiments, the circuit board activates 410 the inflation device in response to determining that a duration of the actuation event is longer than a threshold amount of time. The inflation device is in fluid communication with a valve (e.g., valve 215) and a balloon (e.g., balloon 105). The activated inflation device creates an airflow that displaces a plunger inside the valve, thereby allowing the airflow into the balloon. The balloon begins to inflate.

The circuit board activates 415 a motor (e.g., motor 225). In some embodiments, the circuit board activates 415 the motor synchronously with the inflation device (e.g., at the same time, before, or after). The activated motor causes a counterweight to rotate relative to the motor and a housing of the gift box, thereby causing the gift box to shake.

The circuit board deactivates 420 the inflation device after a preprogrammed amount of time. The amount of time may be programmed such that the balloon may be sufficiently inflated.

The circuit board deactivates 425 the motor. In some embodiments, the circuit board deactivates 425 the motor synchronously with the inflation device (e.g., at the same time, before, or after).

The circuit board detects 430 a second actuation event. The second actuation event may be a button press, a switch flip, a pull of a pull string or a pull tab, or a similar trigger by a recipient of the gift box.

The circuit board activates 435 the inflation device. In some embodiments, the circuit board activates 435 the inflation device in response to determining that a duration of the second actuation event is longer than a threshold amount of time. The activated inflation device creates an airflow that displaces the plunger inside the valve, thereby allowing the airflow into the balloon.

The circuit board deactivates 440 the inflation device after a second preprogrammed amount of time. The amount of time may be programmed such that the balloon may be slightly re-inflated or "topped off." In some embodiments, the second preprogrammed amount of time may be shorter in length than the first preprogrammed amount of time.

Various modifications or changes may be made to the method 400 illustrated in FIG. 4. For example, steps 430, 435, and 440 may be omitted. Also, the sequence of steps 410, 415, 420, and 425 may be modified. Steps 415 and 425 may be repeated in combination with steps 435 and 440.

Figure 5C:
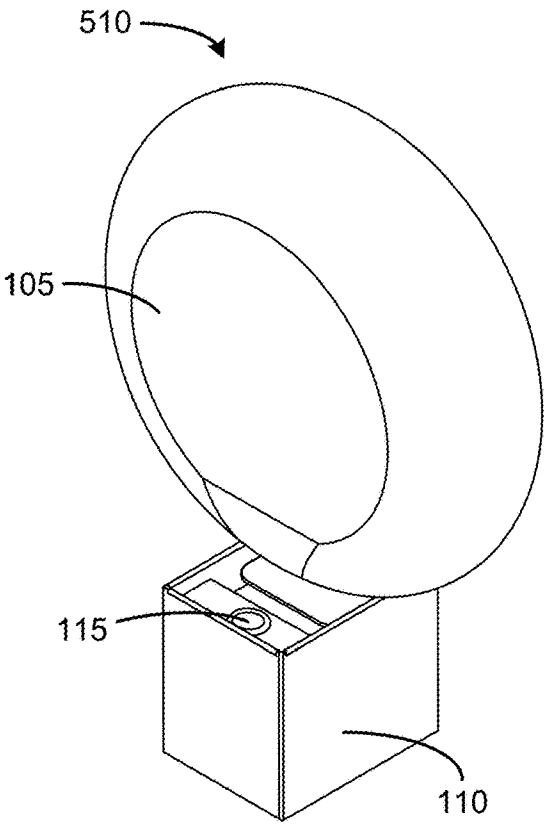
FIGS. 5A-5C illustrate the gift box in an initial configuration, in an intermediate configuration, and in a final configuration, according to an embodiment.
Figure 5B:
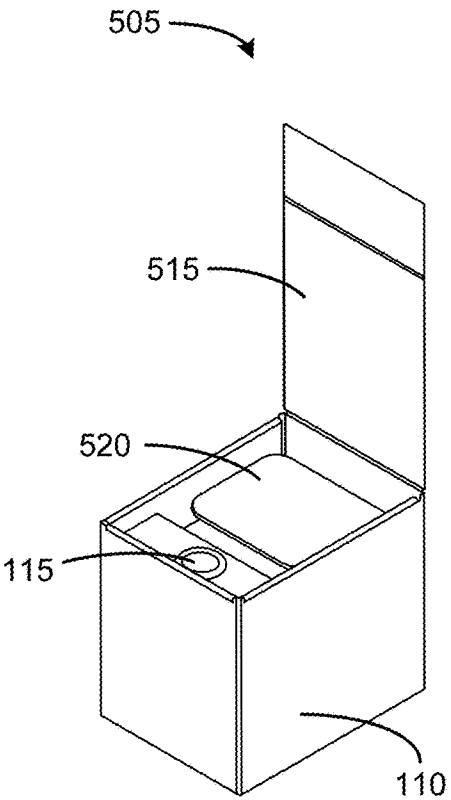
Figure 5A:
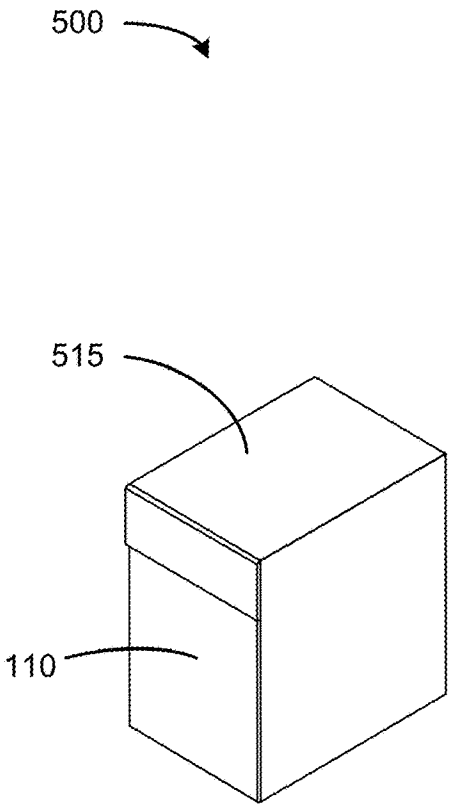

FIGS. 5A-5C illustrate the gift box 100 in an initial configuration 500, in an intermediate configuration 505, and in a final configuration 510, according to an embodiment.

The initial configuration 500 illustrates the gift box 100 with a lid 515 in a closed position. A portion of the lid 515 may be secured to the housing 110 with an adhesive, tape, a pull tab, a flap and pocket, or some combination thereof. In the initial configuration 500, the gift box 100 may be ready-to-ship and may not need additional shipping or packaging materials. In some instances, the gift box 100 may be shipped to a distributor without a balloon or a power source and may be assembled at later stages.

The intermediate configuration 505 illustrates the gift box 100 with the lid 515 in an open position. The recipient may have broken the seal between the lid 515 and the housing 110. In the intermediate configuration 505, the balloon 105 may be inside a compartment 520 of the housing 110 such that the balloon 105 is hidden from the view of the recipient, while the recipient may be able to view and access the switch 115. In some embodiments, a bottom surface of the lid 515 may display a personalized message for the recipient, or an insert card with a personalized message may be inside the gift box. The message may also include instructions for the recipient to actuate the switch 115. The recipient may actuate the switch 115, and the gift box 100 may begin to shake and the balloon 105 may begin to emerge from its compartment. The circuit board 235 (not shown) detects the actuation event of the switch 115 and subsequently activates the inflation device 210 (not shown) and the motor 225 (not shown). In embodiments in which the gift box 100 does not include a switch, the circuit board 235 may detect the lid 515 in an open position or that the seal of the gift box 100 is broken.

The final configuration 510 illustrates the gift box 100 with the balloon 105 sufficiently inflated. The circuit board 235 (not shown) may deactivate the inflation device 210 (not shown) and the motor 225 (not shown) after a predetermined amount of time such that the balloon 105 is inflated to a target capacity. The gift box 100 and the balloon 105 may remain displayed for the recipient. If the balloon 105 deflates over time, the recipient may actuate the switch 115, which may slightly re-inflate the balloon 105. The circuit board 235 detects the second actuation event of the switch 115 and subsequently activates the inflation device 210 for a short amount of time to "top off" the balloon 105. In some embodiments, the circuit board 235 may synchronously activate the motor 225.

Figure 6:
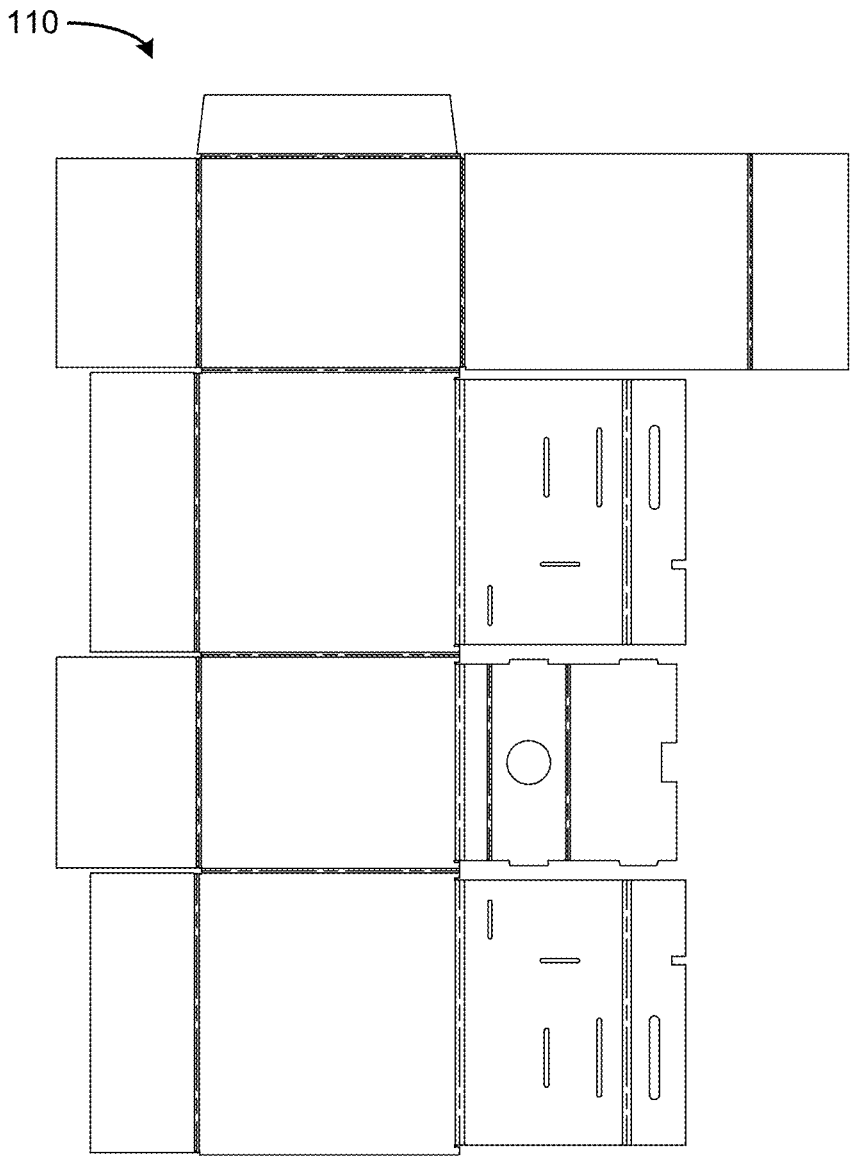
FIG. 6 illustrates a housing of the gift box in an unfolded configuration, according to an embodiment.

FIG. 6 illustrates a housing 110 of the gift box 100 in an unfolded configuration, according to an embodiment. As previously described, the housing 110 is a box that houses the balloon 105 and the internal components of the gift box 100. The housing 110 may be composed of cardboard, corrugated cardboard, foam board, or other suitable materials that are structurally sound and may withstand the shipping process. As illustrated in FIG. 6, the housing 110 is a unitary piece of material that may be assembled into a folded configuration. Once folded, the housing 110 may be secured in the folded configuration using adhesive, tape, or interference fits (e.g., press fit, friction fit, or similar). The housing 110 includes several features that serve as mounts or placeholders for the internal components. For example, the housing 110 may include an inflation device mount, a power source mount, a power source cover, a circuit board mount, a switch mount, valve locating features, motor mounting features, and a securing mechanism for the gift box 100. The housing 110 may additionally include air inlets that allow exterior air to reach an inlet of the inflation device. The housing 110 may also include a compartment to store a deflated balloon.

In some embodiments, the housing 110 may serve as the exterior of the gift box 100 and may include a separate interior piece that is designed to be inserted inside the housing 110. The interior piece may include the mounts and/or placeholders for the internal components such that the interior piece and the interior components can be assembled together and be conveniently placed inside the housing 110. The balloon 105 and the power source 240 may be added at later steps, such as right before the gift box 100 is shipped to a recipient.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A device comprising:

a housing;

a balloon located within the housing, the balloon including an opening;

an inflation device, within the housing, in fluid communication with the opening of the balloon, wherein the inflation device is an electric air pump;

a controller, within the housing, coupled to the inflation device, wherein the controller is configured to activate the inflation device; and a one-way valve configured to couple the inflation device and the opening of the balloon, the one-way valve comprising:

a plunger that is configured to, in a sealed configuration, close the valve, and configured to, in an unsealed configuration, open the valve; and a spring that is configured to apply a first force to the plunger such that the plunger is in the sealed configuration, wherein airflow from an activated inflation device is configured to apply a second force that is greater than the first force to the plunger such that the plunger is in the unsealed configuration, thereby opening the valve and allowing airflow into the balloon.

2. The device of claim 1, further comprising a trigger mechanism configured to be actuated by a user.

3. The device of claim 2, wherein the trigger mechanism is located within the housing and includes a switch accessible to the user when a lid of the housing is in an open position.

4. The device of claim 2, wherein the controller is further configured to activate the inflation device in response to an actuation event of the trigger mechanism, wherein a duration of the actuation event is longer than a threshold amount of time.

5. The device of claim 4, wherein the threshold amount of time is selected from a range between 0 seconds and 0.75 seconds.

6. The device of claim 2, wherein the controller is configured to activate the inflation device in response to a first actuation event of the trigger mechanism, thereby causing air to flow into the balloon for a first pre-determined amount of time such that the balloon is sufficiently inflated.

7. The device of claim 6, wherein the controller is configured to activate the inflation device in response to a second actuation event of the trigger mechanism, thereby causing air to flow into the balloon for a second pre-determined amount, wherein the second pre-determined amount of time is shorter than the first pre-determined amount of time.

8. The device of claim 1, further comprising a vibration motor within the housing and coupled to the controller, wherein the vibration motor is configured to vibrate the device.

9. The device of claim 8, wherein the controller is further configured to activate the vibration motor and the inflation device synchronously.

10. The device of claim 1, wherein the balloon is located within a compartment of the housing such that the balloon is obscured from a user's view when a lid of the housing is in an open position.

11. The device of claim 1, wherein the housing is a unitary piece of material configured to be assembled into a folded configuration and comprising a first mount to mount the inflation device and a second mount to mount the controller.

12. The device of claim 1, wherein the plunger is positioned within a channel of the one-way valve, and the plunger comprises a sealing surface having a diameter that is greater than a diameter of a portion of the channel.

13. The device of claim 1, wherein the plunger is configured to translate along an axis within the channel between the sealed configuration and the unsealed configuration.

14. The device of claim 1, wherein the controller is configured to deactivate the inflation device after a pre-determined amount of time, wherein after deactivation of the inflation device, the inflation device is configured to gradually decrease the airflow to zero such that the second force applied to the plunger gradually decreases.

15. The device of claim 14, wherein, as the second force gradually decreases, the first force applied to the plunger becomes greater than the second force such that the plunger transitions from the unsealed configuration to the sealed configuration, thereby allowing airflow into the balloon for a period of time after deactivation of the inflation device.

16. The device of claim 15, wherein the airflow into the balloon for the period of time after deactivation of the inflation device is configured to maintain a positive pressure differential within the balloon relative to atmospheric pressure.

17. A device comprising:

a housing comprising a lid;

a balloon located within a compartment of the housing such that the balloon is obscured from a user's view when the lid of the housing is in an open position, the balloon including an opening;

an inflation device, within the housing, in fluid communication with the opening of the balloon, wherein the inflation device is an electric air pump; and a controller, within the housing, coupled to the inflation device, wherein the controller is configured to activate the inflation device; and a one-way valve configured to couple the inflation device and the opening of the balloon, the one-way valve comprising:

a plunger that is configured to, in a sealed configuration, close the valve, and configured to, in an unsealed configuration, open the valve; and a spring that is configured to apply a first force to the plunger such that the plunger is in the sealed configuration, wherein airflow from an activated inflation device is configured to apply a second force that is greater than the first force to the plunger such that the plunger is in the unsealed configuration, thereby opening the valve and allowing airflow into the balloon.

18. The device of claim 17, wherein the housing further comprises a message personalized for the user.

19. The device of claim 17, wherein a trigger mechanism is located within the housing and is accessible to the user when the lid of the housing is in an open position.

20. The device of claim 19, wherein the trigger mechanism is configured to be actuated by the user and the controller is configured to activate the inflation device in response to detecting an actuation event of the trigger mechanism.

21. The device of claim 17, wherein the controller is configured to activate the inflation device in response to detecting that the lid of the housing is in an open position.

22. The device of claim 17, wherein the balloon is configured to emerge from the compartment as air flows into the balloon.

* * * * *